US009127588B2

(12) United States Patent
Shirai et al.

(10) Patent No.: US 9,127,588 B2
(45) **Date of Patent: *Sep. 8, 2015**

(54) TWO-CYCLE ENGINE

(75) Inventors: Ken Shirai, Tokyo (JP); Takahiro Yamazaki, Akishima (JP); Naoki Koga, Higashimurayama (JP); Kazumichi Yamaguchi, Hamura (JP)

(73) Assignee: Yamabiko Corporation, Ohme-shi, Tokyo (JP)

( * ) Notice: Subject to any disclaimer, the term of this patent is extended or adjusted under 35 U.S.C. 154(b) by 271 days.

This patent is subject to a terminal disclaimer.

(21) Appl. No.: 13/316,806

(22) Filed: Dec. 12, 2011

(65) Prior Publication Data

US 2012/0145137 A1 Jun. 14, 2012

(30) Foreign Application Priority Data

Dec. 13, 2010 (JP) ..... 2010-276683
Aug. 29, 2011 (JP) ..... 2011-186170

(51) Int. Cl.
*F02B 25/00* (2006.01)
*F02B 25/18* (2006.01)
(Continued)

(52) U.S. Cl.
CPC ..... *F02B 25/18* (2013.01); *F02B 25/22* (2013.01); *F02B 63/02* (2013.01); *F02F 1/22* (2013.01); *F02B 2075/025* (2013.01)

(58) Field of Classification Search
CPC .... F02B 2075/025; F02B 25/14; F02B 25/16; F02B 2720/236; F02B 29/06; F02B 1/22; F02B 3/24; F02B 7/0036; F02M 35/1019; F02M 69/10
USPC ..... 123/65 R, 73 PP, 73 A, 73 AA, 73 R
See application file for complete search history.

(56) References Cited

U.S. PATENT DOCUMENTS 3,934,562 A * 1/1976 Isaka ..... 123/257
4,075,985 A * 2/1978 Iwai ..... 123/73 A
(Continued)

FOREIGN PATENT DOCUMENTS

JP S50-20193 6/1975
JP 59-185850 10/1984
(Continued)

OTHER PUBLICATIONS

Japanese Office Action for JP 2011-186170 mailed Feb. 17, 2015 (4 pages).

*Primary Examiner* — Lindsay Low
*Assistant Examiner* — Long T Tran
(74) *Attorney, Agent, or Firm* — Merchant & Gould P.C.

(57) ABSTRACT

An engine includes a cylinder block, and a piston slidably mounted in a cylinder, with the cylinder block being formed with an exhaust passage leading to a combustion chamber through an exhaust port, a first scavenging port opened to an inner circumferential surface of the cylinder, a first communication passage formed from the first scavenging port in a radial direction of the cylinder, and a first scavenging passage formed with an opening on a bottom surface of the first communication passage, in which a side surface on a far side from the exhaust port forming the communication passage is formed towards the far side from the exhaust port in the combustion chamber, and the opening portion of the first scavenging passage and a landing portion formed in the periphery of the opening portion are formed at a bottom portion of the communication passage.

8 Claims, 9 Drawing Sheets

(51) Int. Cl.

| | |
|---|---|
| ***F02F 1/22*** | (2006.01) |
| ***F02B 25/22*** | (2006.01) |
| ***F02B 63/02*** | (2006.01) |
| *F02B 75/02* | (2006.01) |

(56) References Cited

U.S. PATENT DOCUMENTS

| | | | | |
|---|---|---|---|---|
| 5,251,580 | A * | 10/1993 | Torigai | 123/65 P |
| 6,497,204 | B1 * | 12/2002 | Miyazaki et al. | 123/73 PP |
| 6,662,766 | B2 * | 12/2003 | Araki et al. | 123/73 PP |
| 7,857,881 | B2 * | 12/2010 | Sato et al. | 55/385.3 |
| 2005/0183679 | A1 * | 8/2005 | Yasuda | 123/73 PP |
| 2009/0283079 | A1 * | 11/2009 | Tsunoda | 123/65 PD |
| 2010/0037877 | A1 * | 2/2010 | Yasutomi et al. | 123/73 A |
| 2010/0059030 | A1 * | 3/2010 | Ishida | 123/73 R |
| 2010/0192928 | A1 * | 8/2010 | Yuasa | 123/65 V |
| 2011/0017183 | A1 * | 1/2011 | Koga et al. | 123/73 PP |
| 2011/0061636 | A1 * | 3/2011 | Mavinahally et al. | 123/65 PD |

FOREIGN PATENT DOCUMENTS

| | | |
|---|---|---|
| JP | S56-41136 | 9/1991 |
| JP | 2003-083158 | 3/2003 |
| JP | 2009-002311 A | 1/2009 |

* cited by examiner

TWO-CYCLE ENGINE

CROSS REFERENCE TO RELATED APPLICATIONS

The present application claims benefit of the filing date of Japanese Patent Application No. 2010-276683 filed on Dec. 13, 2010 and Japanese Patent Application No. 2011-186170 filed on Aug. 29, 2011.

BACKGROUND OF THE INVENTION

1. Field of the Invention

The present invention relates to a two-cycle engine, i.e. a two-stroke internal combustion engine (hereinafter called "two-stroke engine"), used on a portable power working machine.

2. Description of the Related Art

In a cylinder block of a two-stroke engine used on a portable power working machine such as chainsaws, brush cutters, and blowers, formed are an intake passage leading to a crank chamber, an exhaust passage leading to a combustion chamber of an upper portion of the cylinder, and a scavenging passage that makes the crank chamber and the combustion chamber communicate with each other.

In a two-stroke engine, an air-fuel mixture gas (hereinafter called "a mixture gas") flows into the crank chamber through the intake passage. Then, the mixture gas flows into the combustion passage, and the mixture gas is combusted in the combustion chamber, and by an expansion power of the mixture gas when combusted in the combustion chamber, a piston is reciprocated in the cylinder (for example, see Japanese Unexamined Patent Application Publication No 2009-002311).

In the above-described two-stroke engine, when the piston descends after the combustion of the mixture gas, an exhaust port of the exhaust passage opens up to the upper portion of the cylinder, and the post-combustion gas in the combustion chamber is exhausted to the exhaust passage (exhaust process). When the piston descends further, a scavenging port of the scavenging passage is opened to the upper portion of the cylinder, and the mixture gas in the crank chamber flows into the combustion chamber through the scavenging passage (scavenging process).

Conventionally, in the scavenging process of the two-stroke engine, because both the exhaust port and the scavenging port are opened to the cylinder, the unburned mixture gas flowed into the combustion chamber from the scavenging port is also exhausted to the exhaust port together with the post-combustion gas in the combustion chamber. When the amount of unburned gas contained in the exhaust gas increases, the amount of hydrocarbon (HC) contained in the exhaust gas increases.

In the conventional two-stroke engine, when scavenging efficiency and combustion efficiency are low, there has been a problem in that the amount of carbon monoxide (CO) contained in the exhaust gas is increased.

The present invention has been developed to solve the above-described problem, and an object of the invention is to provide a two-stroke engine that allows the unburned gas contained in the exhaust gas to be reduced, and the scavenging efficiency and the combustion efficiency to be improved.

SUMMARY OF THE INVENTION

In order to attain the above-described object, the present invention provides a two-stroke engine including a cylinder block formed with a cylinder and a crank chamber, and a piston slidably mounted in the cylinder, with the cylinder block being formed with an exhaust passage leading to a combustion chamber in the cylinder through an exhaust port opened to an inner circumferential surface of the cylinder, a scavenging port opened to an inner circumferential surface of the cylinder, a communication passage formed from the scavenging port in a radial direction of the cylinder, and a scavenging passage formed in an axial direction of the cylinder, communicating with the crank chamber, and having an opening portion formed on a bottom surface of the communication passage. A side surface forming a part of the communication passage on a far side from the exhaust port is formed towards the far side from the exhaust port in the combustion chamber. Furthermore, the opening portion of the scavenging passage and a landing portion formed in a periphery of the opening portion of the scavenging passage are formed at a bottom portion of the communication passage.

In the above-described configuration, a mixture gas flowing into the combustion chamber from the scavenging port is directed towards the far side from the exhaust port, whereby the amount of unburned mixture gas exhausted to the exhaust port can be substantially reduced.

Forming the landing portion in the periphery of the opening portion of the scavenging passage makes a space in the periphery of the opening portion expand in the communication passage, whereby the mixture gas compressed in the scavenging passage is expanded in the communication passage and jetted in the combustion chamber. This promotes atomization and mixture of the mixture gas and provides changes in pressure and speed of the mixture gas. More specifically, it has an effect of reducing the pressure and the speed of the mixture gas by a certain degree when the mixture gas flows into the cylinder. Furthermore, by the mixture gas flowed in the combustion chamber on the far side from the exhaust port, the post-combustion gas in the combustion chamber is pushed out to the exhaust port. Consequently, the scavenging efficiency and the combustion efficiency can be improved.

Because of the improvement in scavenging efficiency and combustion efficiency, the mixture gas in an amount necessary for combustion can be introduced in the cylinder even when the cross-sectional area of the scavenging passage is made small, and thus the compression ratio (primary compression ratio) of the mixture gas in the crank chamber and in the scavenging passage can be made large, whereby the output performance of the engine can be enhanced.

Moreover, the smaller the cross-sectional area of the scavenging passage will be able to freely planning of the passage layout in the cylinder block. For example, making the thickness of sidewall portions of the cylinder block large and making receiving surfaces of bearings that rotatably support a crank journal of a crank shaft large allow the simultaneous rotation of the bearings to be prevented and the durability of the bearings to be enhanced.

The position of the landing portion is not restricted as long as it is located in the periphery of the opening portion of the scavenging passage. For example, the landing portion may be set in between the opening portion of the scavenging passage and a side surface of the communication passage on the far side from the exhaust port. The landing portion may be set in between the opening portion of the scavenging passage and a side surface of the communication passage on the exhaust port side. Furthermore, the respective landing portions may be formed between the opening portion of the scavenging passage and both side surfaces of the communication passage on the far side from the exhaust port and on the exhaust port side.

When the landing portion is formed to be set in between the opening portion of the scavenging passage and the side surface of the communication passage on the far side from the exhaust port, the opening portion of the scavenging passage is separated from the side surface on the far side from the exhaust port by the landing portion, and thus the mixture gas flowed in the communication passage from the opening portion of the scavenging passage is hard to hit the side surface on the far side from the exhaust port, whereby the mixture gas can be prevented from hitting on the side surface on the far side from the exhaust port and being reflected towards the exhaust port side.

Consequently, the mixture gas flowing in the combustion chamber from the scavenging port can be reliably directed towards the far side from the exhaust port, whereby the amount of unburned mixture gas exhausted to the exhaust port can be substantially reduced.

The landing portion can be formed by laterally shifting the side surface of the communication passage on the far side from the exhaust port towards the far side from the exhaust port with respect to the scavenging passage. Accordingly, the landing portion can be formed in the communication passage by casting and the like, the performance of the engine can be substantially improved without altering a basic structure and a manufacturing process of the existing engine.

In the above-described two-stroke engine, it is preferable that the cross-sectional area of the communication passage in the axial direction of the cylinder be made larger than the cross-sectional area of the scavenging passage in the radial direction of the cylinder.

In the configuration above, the mixture gas compressed in the scavenging passage can be expanded more effectively in the communication passage, thereby promoting the atomization and the mixture of the mixture gas and providing the changes in the pressure and the speed of the mixture gas, whereby the scavenging efficiency and the combustion efficiency can be substantially improved.

Furthermore, when the scavenging port is formed in a divergent form by making the opening width of the communication passage in a circumferential direction of the cylinder wider from an opening portion side of the scavenging passage towards a scavenging port side, and by making a ceiling surface of the communication passage inclined towards a cylinder head side from a scavenging passage side towards a scavenging port side, the mixture gas jetted in the combustion chamber from the scavenging port is effectively dispersed, whereby the scavenging efficiency and the combustion efficiency can be further improved.

In the above-described two-stroke engine, when two of the scavenging ports are formed on each side of the exhaust port, the post-combustion gas is pushed out by the mixture gas flowed in the combustion chamber on the far side from the exhaust port from the both sides of the exhaust port, whereby the scavenging efficiency can be further improved.

Moreover, the mixture gases flowed in the combustion chamber from the scavenging ports on both sides collide with one another, thereby promoting the mixture and the dispersion of the mixture gas, whereby the combustion efficiency can be further improved.

In the two-stroke engine of the invention, without altering the basic structure and the manufacturing process of an existing engine, the amount of hydrocarbon (HC) contained in the exhaust gas can be substantially reduced and the scavenging efficiency and the combustion efficiency can be improved, whereby the amount of carbon monoxide (CO) contained in the exhaust gas can be substantially reduced.

In particular, when the scavenging ports are formed in a divergent form, because the mixture gas jetted in the combustion chamber from the scavenging ports is effectively dispersed, the scavenging efficiency and the combustion efficiency can be further improved.

DETAILED DESCRIPTION OF THE PREFERRED EMBODIMENT

Embodiments of the present invention will be described in detail below with reference to the drawings as appropriate. In the following descriptions of the embodiments, the same constituent elements have the same reference symbols and their redundant descriptions are omitted.

First Embodiment

Figure 1:
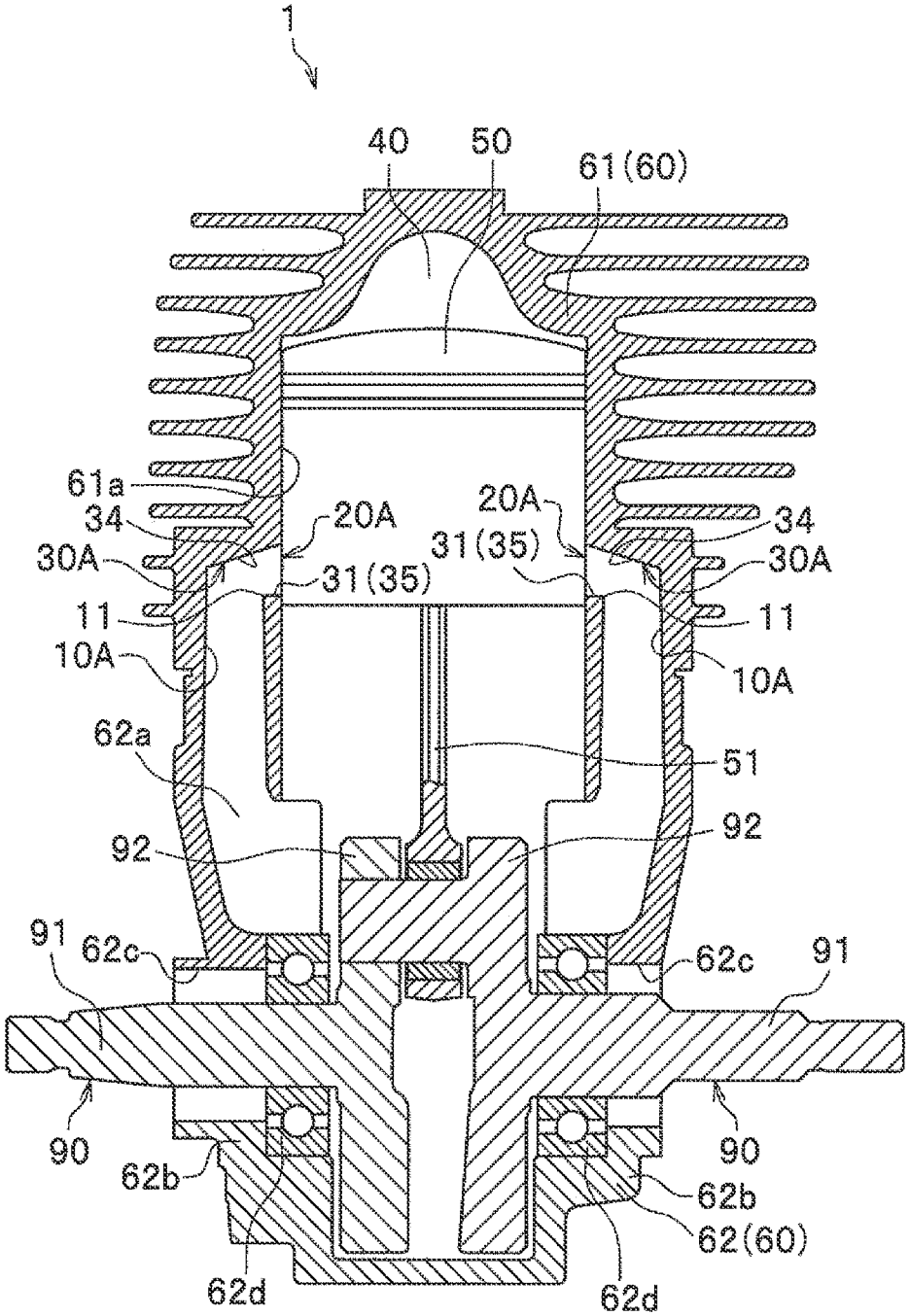
FIG. 1 is a cross-sectional view of an engine of a first embodiment in an intake and compression process viewed from an intake passage side.

An engine 1 of a first embodiment illustrated in FIG. 1 is a two-stroke engine used for portable power working machines such as chainsaws, brush cutters, and blowers.

Figure 2:
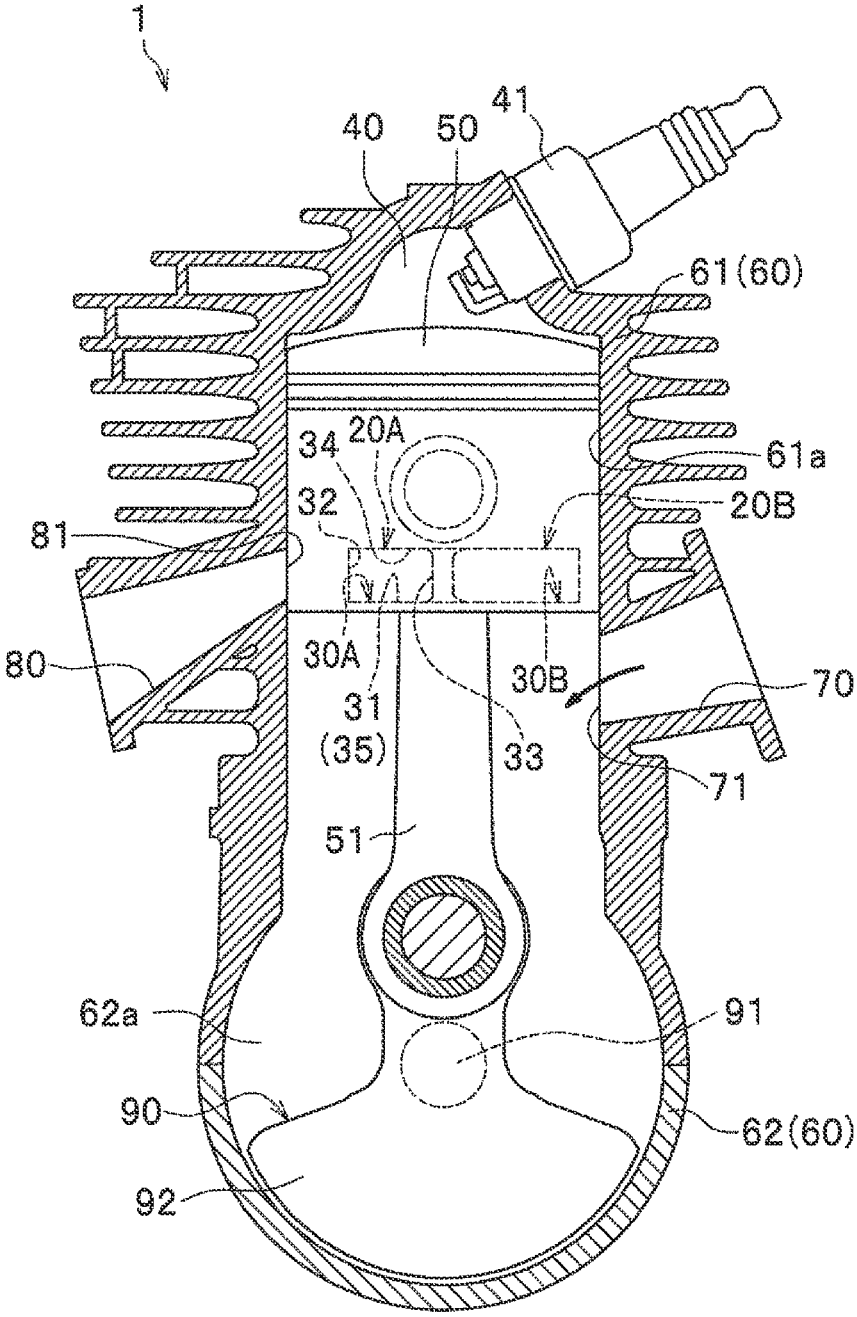
FIG. 2 is a cross-sectional side view of the engine of the first embodiment illustrating the intake and compression process.

The engine 1 primarily includes, as illustrated in FIG. 2, a cylinder block 60 formed with a cylinder 61*a* and a crank chamber 62*a*, a piston 50 slidably mounted in the cylinder 61*a*, an intake passage 70 leading to the crank chamber 62*a*, an exhaust passage 80 leading to a combustion chamber 40, scavenging passages 10A, 10B (see FIG. 5) that makes the crank chamber 62*a* and the combustion chamber 40 communicate with each other, and a crank shaft 90 arranged in the crank chamber 62*a*.

The configurations of various engine mechanisms in the engine 1 of the first embodiment are the same as those of known two-stroke engines, and thus the detailed descriptions for other than specific configurations constituting the present invention are omitted.

In the above-described engine 1, when the piston 50 ascends in the cylinder 61*a*, inside the crank chamber 62*a* is negative pressured, and a mixture gas of fuel and air produced in a carburetor (not depicted) fills up the crank chamber 62*a* through the intake passage 70.

When the piston 50 reaches a top dead point, a mixture gas flowed in the cylinder 61*a* in a scavenging process of a previous combustion cycle is compressed in the combustion chamber 40. When the mixture gas is ignited by an ignition plug 41, the piston 50 is then pushed downwards by an expansion power of the mixture gas.

Figure 3:
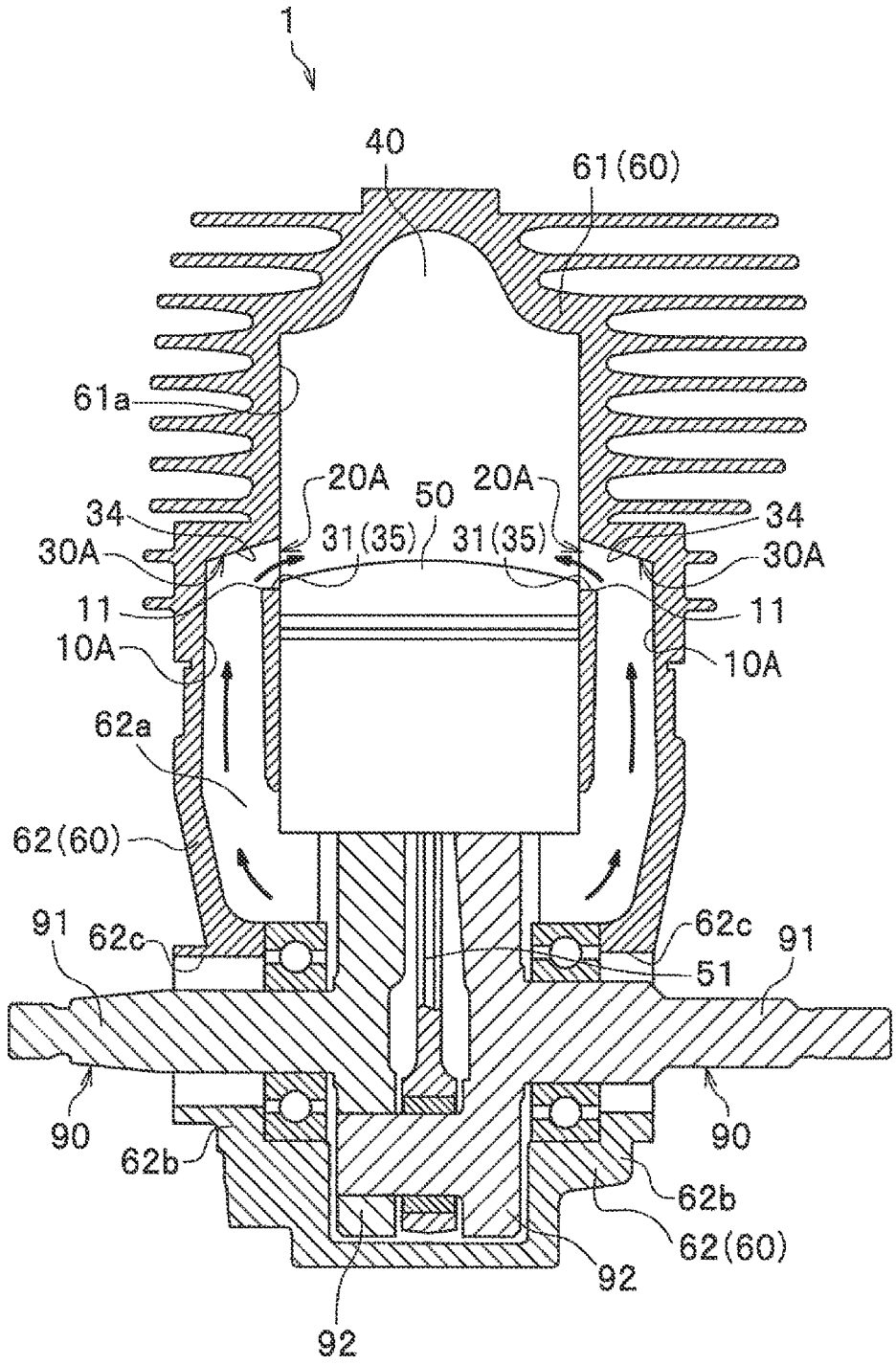
FIG. 3 is a cross-sectional view of the engine of the first embodiment in a scavenging process viewed from the intake passage side.
Figure 4:
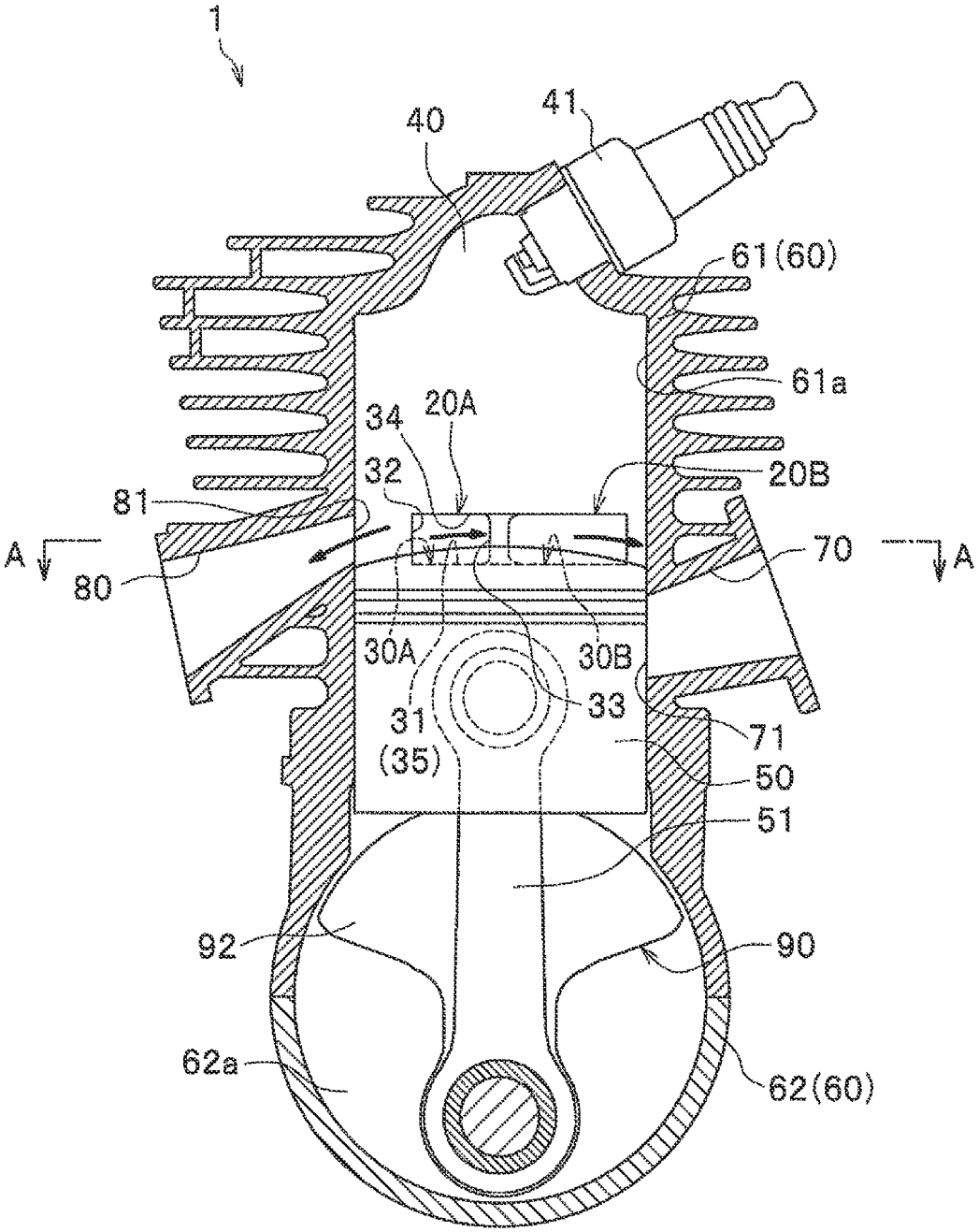
FIG. 4 is a cross-sectional side view of the engine of the first embodiment illustrating the scavenging process.

When the piston 50 descends, as illustrated in FIG. 4, the exhaust passage 80 becomes in a state communicating with the combustion chamber 40, and the post-combustion gas is exhausted to the exhaust passage 80. Furthermore, as illustrated in FIG. 3, by the descent of the piston 50, the mixture gas filled in the crank chamber 62*a* is compressed.

Figure 5:
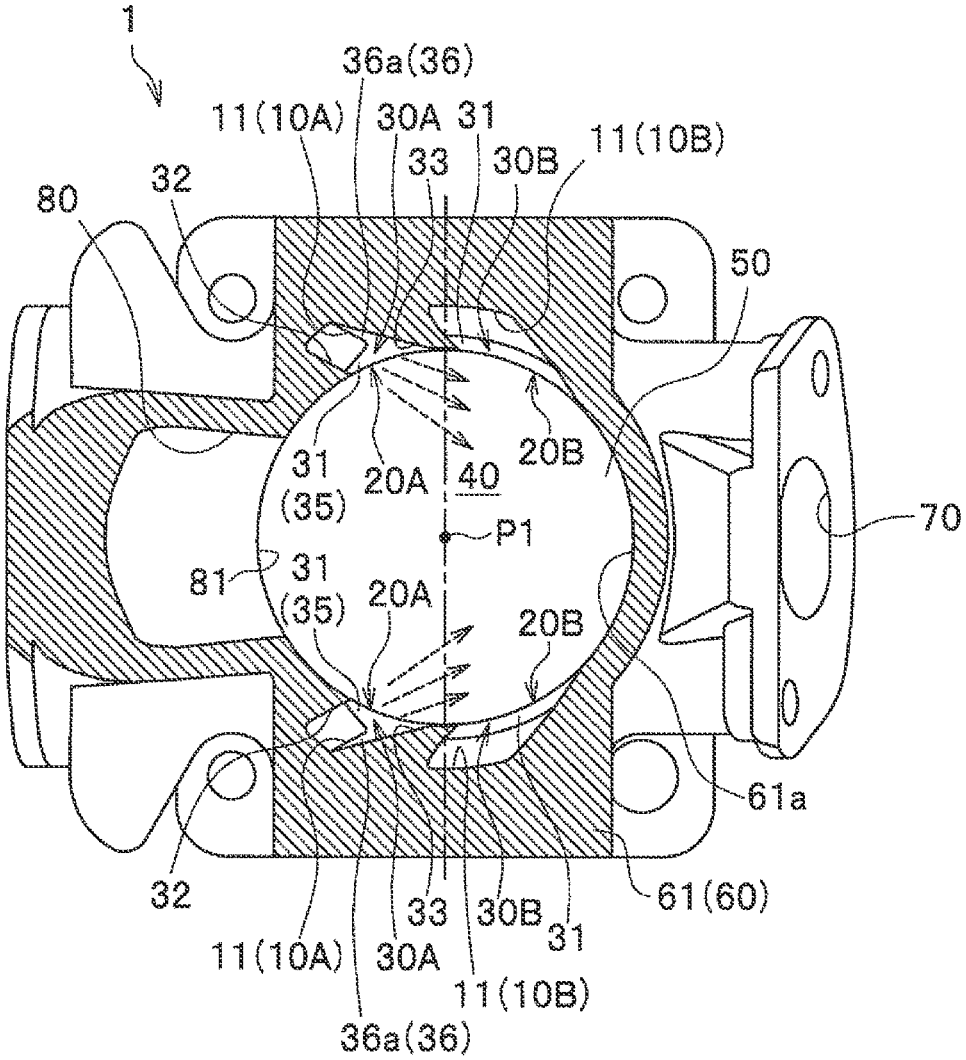
FIG. 5 is a cross-sectional view of the engine of the first embodiment viewed along the line A-A in FIG. 4 illustrating the scavenging process.

When the piston 50 reaches a bottom dead point, as illustrated in FIG. 5, the scavenging passages 10A, 10B become in a state communicating with the combustion chamber 40, and the mixture gas flows into the combustion chamber 40 through the scavenging passages 10A, 10B.

As illustrated in FIG. 3, the piston 50 reaching the bottom dead point then ascends again by the torque of the crank shaft 90, and thus the intake and compression process is repeated.

The cylinder block 60 is, as illustrated in FIG. 1, divided into an upper block 61 formed with the cylinder 61*a* and an upper portion of the crank chamber 62*a* and a lower case 62 formed with a lower portion of the crank chamber 62*a*, and the upper block 61 and the lower case 62 are assembled one above the other.

On the crank shaft 90, a crank journal 91 rotatably supported on the lower case 62 and a crank web 92 formed on the crank journal 91 are formed.

On inner circumferential surfaces of inserting holes 62*c* formed on sidewall portions 62*b* of the lower case 62, bearings 62*d* are fitted in. In other words, the inner circumferential surfaces of the inserting holes 62*c* are receiving surfaces of the bearings 62*d*.

The crank journal 91 is inserted into the bearings 62*d*, and the leading ends of the crank journal protrude outside.

The crank web 92 is coupled with the piston 50 via a connecting rod 51, and the crank web 92 is configured to rotate around an axis of the crank journal 91 in response to the reciprocation of the piston 50.

The intake passage 70, as illustrated in FIG. 2, is formed on a side portion (a right side portion in FIG. 2) of the upper block 61, and one end thereof is opened to a lower portion of the cylinder 61*a* and the other end thereof is connected to a fuel supply passage not depicted.

An opening portion 71 of the intake passage 70 on a cylinder 61*a* side is blocked by a side surface of the piston 50 when the piston 50 is positioned at the bottom dead point as illustrated in FIG. 4, and is opened to the lower portion of the cylinder 61*a* communicating with the crank chamber 62*a* when the piston 50 is positioned at the top dead point as illustrated in FIG. 2.

The exhaust passage 80, as illustrated in FIG. 2, is formed on a side portion (a left side portion in FIG. 2) of the upper block 61 at a position on a side opposite to the intake passage 70. One end of the exhaust passage 80 is formed with an exhaust port 81 opened to an inner circumferential surface of the cylinder 61*a*, and the other end thereof is connected to an exhaust muffler which is not depicted.

The exhaust port 81 comes to a state communicating with the combustion chamber 40 when the piston 50 is positioned at the bottom dead point as illustrated in FIG. 4, and is blocked by a side surface of the piston 50 when the piston 50 is positioned at the top dead point as illustrated in FIG. 2.

The scavenging passages 10A, 10B are formed, as illustrated in FIG. 5, along an axial direction of the cylinder 61*a* (see FIG. 1) at positions lateral to the cylinder 61*a* (upper lateral and lower lateral in FIG. 5) in the upper block 61.

On a side towards the exhaust port 81 from a center position P1 of the cylinder 61*a*, two of first scavenging passages 10A, 10A are formed across the cylinder 61*a* at positions horizontally symmetrical in FIG. 5. Furthermore, on a side towards the intake passage 70 from the center position P1 of the cylinder 61*a*, two of second scavenging passages 10B, 10B are formed across the cylinder 61*a* at positions horizontally symmetrical in FIG. 5.

The first scavenging passages 10A, as illustrated in FIG. 1, communicate with the crank chamber 62*a* at lower end portions thereof. On upper end portions of the first scavenging passages 10A, opening portions 11 having a rectangular cross-section are formed at bottom surfaces 31 of later described first communication passages 30A.

In FIGS. 1 and 3, to make configurations of the first scavenging passages 10A, the first communication passages 30A, and first scavenging ports 20A easier to comprehend, the first scavenging passages 10A, the first communication passages 30A, and the first scavenging ports 20A are depicted on the cross section of the center position of the cylinder block 60.

Furthermore, second scavenging passages 10B depicted in FIG. 5, as the same as those of the first scavenging passages 10A, also communicate with the crank chamber 62*a* at lower end portions thereof (see FIG. 4), and opening portions 11 opened to bottom surfaces 31 of later described second communication passages 30B at upper end portions thereof.

The scavenging ports 20A, 20B are, as illustrated in FIG. 5, opening portions having a rectangular cross-section opened to the inner circumferential surface of the cylinder 61*a* (see FIG. 4).

At positions on both sides of the exhaust port 81 (upper and lower sides in FIG. 5) on the side towards the exhaust port 81 from the center position P1 of the cylinder 61*a*, two of the first scavenging ports 20A, 20A are formed across the cylinder 61*a* facing each other. Furthermore, at positions on both sides of the exhaust port 81 on the side towards the intake passage 70 from the center position P1, two of second scavenging ports 20B, 20B are formed across the cylinder 61*a* facing each other.

The respective scavenging ports 20A, 20B are opened, as illustrated in FIG. 4, to the inner circumferential surface of the cylinder 61*a* at about the same height as that of the exhaust port 81. Therefore, the scavenging ports 20A, 20B are opened to the upper portion of the cylinder 61*a* and come to a state communicating with the combustion chamber 40 when the piston 50 is positioned at the bottom dead point, and are blocked by the side surface of the piston 50, as illustrated in FIG. 2, when the piston 50 is positioned at the top dead point.

The communication passages 30A, 30B are, as illustrated in FIG. 5, passage ways formed in a radial direction of the cylinder 61*a*, and at bottom portions 35 of the communication passages 30A, 30B, the opening portions 11 of the scavenging passages 10A, 10B and landing portions 36 formed in the periphery of the opening portions 11 are formed. The communication passages 30A, 30B are passage ways that make the opening portions 11, 11 opened to the bottom surfaces 31 of the bottom portions 35 communicate with the scavenging ports 20A, 20B opened to the inner circumferential surface of the cylinder 61*a*.

The communication passages 30A, 30B are formed from the opening portions 11 formed at the bottom surfaces 31 towards a far side from the exhaust port that is a side opposite to the exhaust port 81 (an intake passage 70 side) in the combustion chamber 40 (cylinder 61*a*).

Consequently, the mixture gas flowed in the communication passages 30A, 30B from the opening portions 11 is guided towards the far side from the exhaust port by the communication passages 30A, 30B, and jetted in the combustion chamber 40 in a direction towards the far side from the exhaust port from the scavenging ports 20A, 20B.

The communication passages 30A, 30B have a rectangular cross-section, as illustrated in FIG. 4, each formed with the bottom surface 31, both side surfaces 32, 33, and a ceiling surface 34.

The side surfaces 33 on the far side from the exhaust port out of the both side surfaces 32, 33 forming part of the communication passages 30A, 30B are inclined, as illustrated in FIG. 5, from the outside in the radial direction of the cylinder 61*a* towards the scavenging ports 20A, 20B in the upper block 61 so as to be away from the side surfaces 32 on the exhaust port 81 side. In other words, the side surfaces 33 of the communication passages 30A, 30B on the far side from the exhaust port are formed directed towards the far side from the exhaust port in the combustion chamber 40 (cylinder 61*a*). The opening widths of the communication passages 30A, 30B in a circumferential direction (lateral direction) of the cylinder 61*a* are expanded from the opening portions 11 towards the scavenging ports 20A, 20B.

Furthermore, the ceiling surfaces 34 of the communication passages 30A, 30B are inclined, as illustrated in FIG. 1, towards a cylinder head side (upper side in FIG. 1) from the opening portions 11 towards the scavenging ports 20A, 20B (see FIG. 5). In other words, the heights of the communication passages 30A, 30B are increased from the outside in the radial direction of the cylinder 61*a* towards the scavenging ports 20A, 20B in the upper block 61.

As described in the foregoing, the communication passages 30A, 30B are formed in a divergent form in which the cross-sectional areas of the passages expand from the opening portions 11 towards the scavenging ports 20A, 20B. The cross-sectional areas of the communication passages 30A, 30B in the axial direction of the cylinder 61*a* are made large than the respective cross-sectional areas of the opening portions 11 in the radial direction of the cylinder 61*a*.

Figure 6:
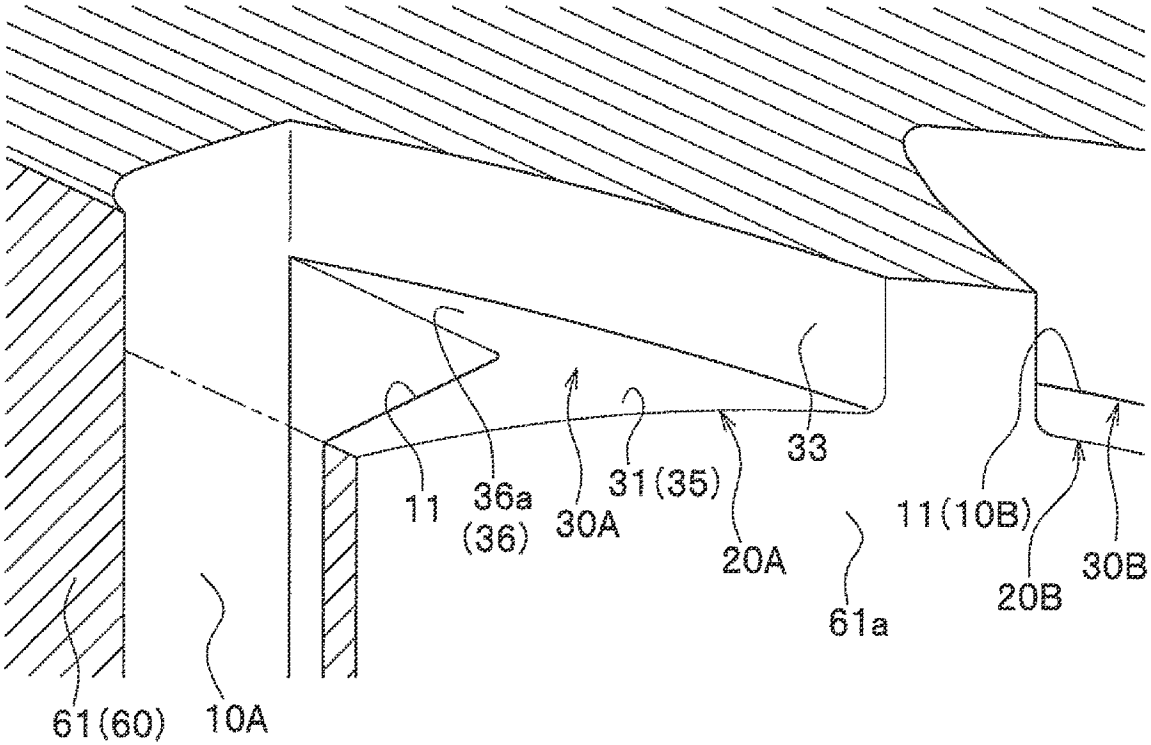
FIG. 6 is a enlarged cross-sectional perspective view of a portion of a first scavenging port of the first embodiment.

The landing portion 36 formed at the bottom portion 35 of the first communication passage 30A is, as illustrated in FIG. 6, set in between an edge portion of the opening portion 11 and the side surface 33 on the far side from the exhaust port. The landing portion 36 is a portion in a triangular shape in planar view the width of which widens from the opening portion 11 side towards the first scavenging port 20A side, is at the same height as that of the bottom surface 31 of the bottom portion 35, and has a planar surface 36*a* constituting a part of the bottom surface 31.

The landing portion 36 is a portion formed by laterally shifting the side surface 33 of the first communication passage 30A on the far side from the exhaust port towards the far side from the exhaust port with respect to an edge portion of the opening portion 11 on the far side from the exhaust port (an inner surface of the first scavenging passage 10A on the far side from the exhaust port).

In the first communication passage 30A, a stepped portion is formed by the inner surface of the first scavenging passage 10A, the landing portion 36, and the side surface 33 on the far side from the exhaust port.

Accordingly, the edge portion of the opening portion 11 and the side surface 33 on the far side from the exhaust port are separated from each other in the lateral direction (circumferential direction of the cylinder 61*a*) across the landing portion 36. In the periphery of the opening portion 11, a space expanded towards the far side from the exhaust port is formed over the landing portion 36.

The engine 1 of the first embodiment thus configured has the following operations and effects.

As illustrated in FIG. 3, when the piston 50 moves to the bottom dead point, the first scavenging ports 20A, 20A come to a state communicating with the combustion chamber 40. Consequently, the mixture gas filled inside the crank chamber 62*a* flows in the combustion chamber 40 through the first scavenging passages 10A, 10A, the first communication passages 30A, 30A, and the first scavenging ports 20A, 20A. The mixture gas is compressed when the mixture gas is flowed into the first scavenging passages 10A.

As illustrated in FIG. 5, the space in the periphery of the opening portion 11 is expanded in the first communication passage 30A by the landing portion 36 formed between the opening portion 11 of the first scavenging passage 10A and the side surface 33 of the first communication passage 30A on the far side from the exhaust port, and the cross-sectional area of the first communication passage 30A in the axial direction of the cylinder 61*a* is larger than the cross-sectional area of the opening portion 11 of the first scavenging passage 10A in the radial direction of the cylinder 61*a*. This makes the mixture gas flowed in the first communication passage 30A from the opening portions 11 expand in the first communication passage 30A.

The communication passages 30A are formed, as illustrated in FIG. 3, in a divergent form the cross-sectional area of which expands from the opening portions 11 towards the first scavenging ports 20A. This makes the mixture gas jetted in the combustion chamber 40 from the first scavenging ports 20A disperse effectively.

Consequently, because the atomization and mixture of the mixture gas can be promoted and the changes in the pressure and speed of the mixture gas can be caused, the scavenging efficiency and the combustion efficiency of the mixture gas can be substantially improved.

As illustrated in FIG. 5, because the edge portion of the opening portion 11 and the side surface 33 on the far side from the exhaust port are separated across the landing portion 36 (see FIG. 6), the mixture gas flowed into the first communication passage 30A from the opening portion 11 is hard to hit the side surface 33 on the far side from the exhaust port.

Accordingly, the mixture gas can be prevented from being reflected towards the exhaust port side by hitting the side surface 33 on the far side from the exhaust port, and thus the mixture gas flowed in the combustion chamber 40 from the first scavenging port 20A is reliably directed towards the far side from the exhaust port 81. Consequently, the amount of unburned mixture gas exhausted to the exhaust port 81 is substantially reduced.

When the piston 50 reaches the bottom dead point, similarly to that of the first scavenging ports 20A, the mixture gas also flows into the combustion chamber 40 from the second scavenging ports 20B. The mixture gas flowed into the combustion chamber 40 through the second scavenging ports 20B is directed, on the exhaust port 81 side from the second scavenging ports 20B, towards the far side from the exhaust port by the mixture gas flowed in towards the far side from the exhaust port from the first scavenging ports 20A.

Therefore, although the landing portions 36 are not formed on the second communication passages 30B of the first embodiment unlike the first communication passage 30A, if the landing portions are formed on the second communication passages 30B, the mixture gas that flows into the combustion chamber 40 from the respective scavenging ports 20A, 20B can be flowed towards the far side from the exhaust port more smoothly.

Furthermore, by the mixture gas flowing into the combustion chamber 40 towards the far side from the exhaust port from the respective scavenging ports 20A, 20B arranged on both sides of the exhaust port 81, the post-combustion gas is pushed out to the exhaust port 81, whereby the scavenging efficiency of the mixture gas can be improved.

The mixture gases flowing into the combustion chamber 40 from the respective scavenging ports 20A, 20B collide with one another in the combustion chamber 40 promotes the mixture and dispersion of the mixture gas, whereby the combustion efficiency of the mixture gas can be improved.

As described in the foregoing, in the engine 1 of the first embodiment, the amount of hydrocarbon (HC) contained in the exhaust gas can be substantially reduced and the scavenging efficiency and the combustion efficiency can be improved, whereby the amount of carbon monoxide (CO) contained in the exhaust gas can be substantially reduced.

As illustrated in FIG. 6, laterally shifting the side surface 33 on the far side from the exhaust port towards the far side from the exhaust port with respect to the edge portion of the opening portion 11 can form the landing portion 36. Accordingly, because the landing portions 36 can be formed in the first communication passages 30A when casting the cylinder block 60, the performance of the engine 1 can be substantially improved without altering the basic structure and manufacturing process of an existing engine.

It has been confirmed that the engine 1 of the first embodiment, compared with a conventional engine without the landing portions 36 being formed in the first communication passages 30A, reduces the amount of hydrocarbon contained in the exhaust gas by approximately 75% and reduces the amount of carbon monoxide contained in the exhaust gas by approximately 31%.

The engine 1 of the first embodiment, compared with the above-described conventional engine, reduces fuel consumption by about 22%, and as the thermal efficiency is improved, the fuel consumption rate is reduced by about 26%.

The scavenging efficiency and the combustion efficiency being improved allows, as illustrated in FIG. 5, the mixture gas in an amount necessary for combustion to be introduced in the cylinder 61*a* even when the cross-sectional areas are made small. This makes the compression ratio (primary compression ratio) of the mixture gas large in the crank chamber 62*a* (see FIG. 3) and the scavenging passages 10A, 10B, whereby the output performance of the engine 1 can be improved.

Specifically, it has been confirmed that with the engine 1 of the first embodiment, compared with the above-described conventional engine, the cross-sectional areas of the scavenging passages 10A, 10B can be reduced by about 17% and the output is improved by about 4%.

The cross-sectional areas of the scavenging passages 10A, 10B being made small, as illustrated in FIG. 3, allows the thickness of sidewall portions 62*b* of the lower case 62 to be made large. Accordingly, the receiving surfaces for the bearings 62*d* that rotatably support the crank journal 91 can be made large, whereby the simultaneous rotation of the bearings 62*d* can be prevented and the durability of the bearings 62*d* can be enhanced.

While the first embodiment of the present invention has been described in the foregoing, the invention is not restricted to the above-described first embodiment and can be modified as appropriate without departing from the scope of intent.

In the first embodiment, as illustrated in FIG. 5, while four of the scavenging ports 20A, 20B are formed, the number of the scavenging ports is not restricted, and two of the first scavenging ports 20A, 20A only may be formed.

Furthermore, as illustrated in FIG. 6, while the landing portion 36 is shaped in a triangular shape in planar view, the shape thereof is not restricted, and for example, the landing portion 36 may be formed in a rectangle shape along the lower edge portion of the side surface 33 or the side surface 33 may be shaped in a quadratic curve.

Moreover, as illustrated in FIG. 5, while the opening portion 11 has a rectangular cross-section, the shape thereof is not restricted, and for example, the opening portions 11 may have a cross-section in a circular or a triangular shape.

Second Embodiment

Figure 7:
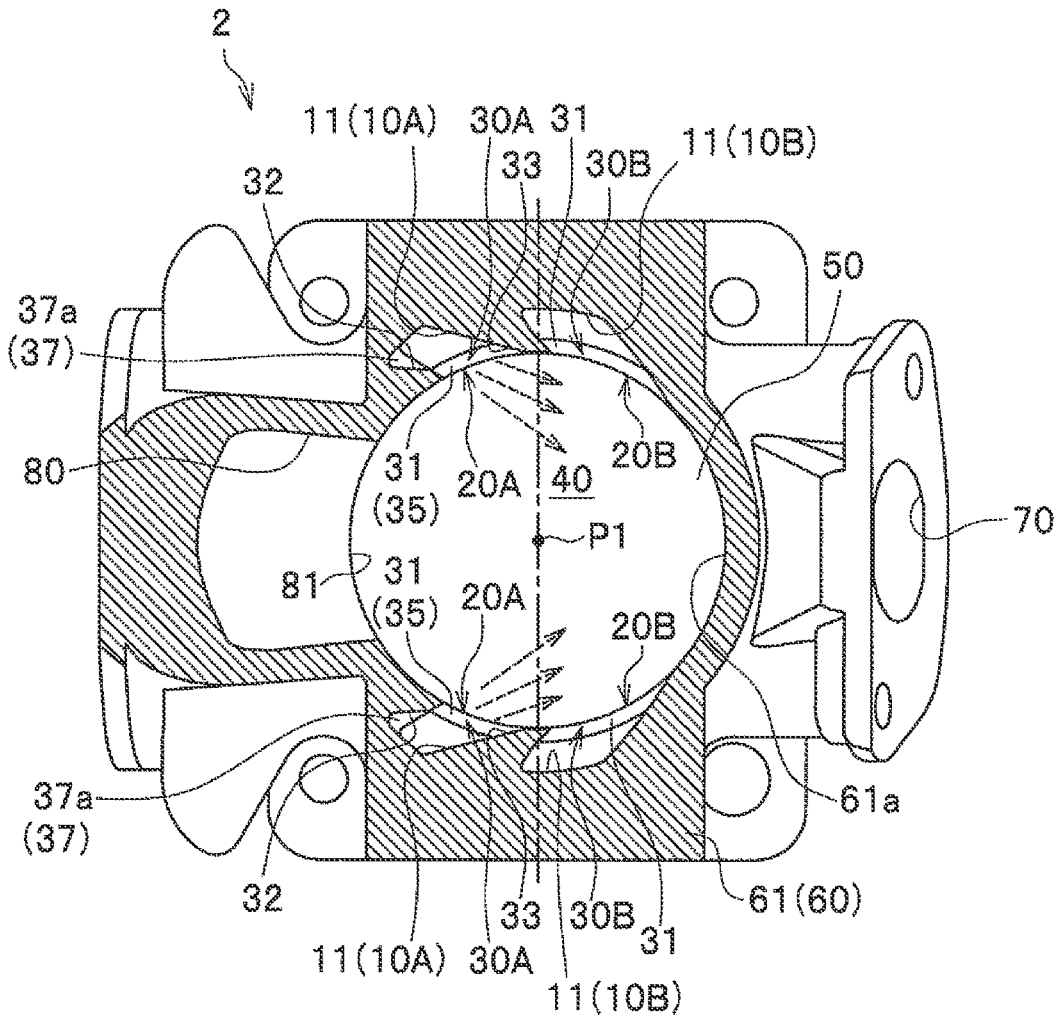
FIG. 7 is a cross-sectional view of an engine of a second embodiment illustrating a scavenging process.

An engine 2 of a second embodiment differs, as illustrated in FIG. 7, from those of the engine 1 of the first embodiment (see FIG. 5) by landing portions 37 at the bottom portions 35 of the first communication passages 30A being set in between edge portions of the opening portions 11 and side surfaces 32 on the exhaust port 81 side.

Figure 8:
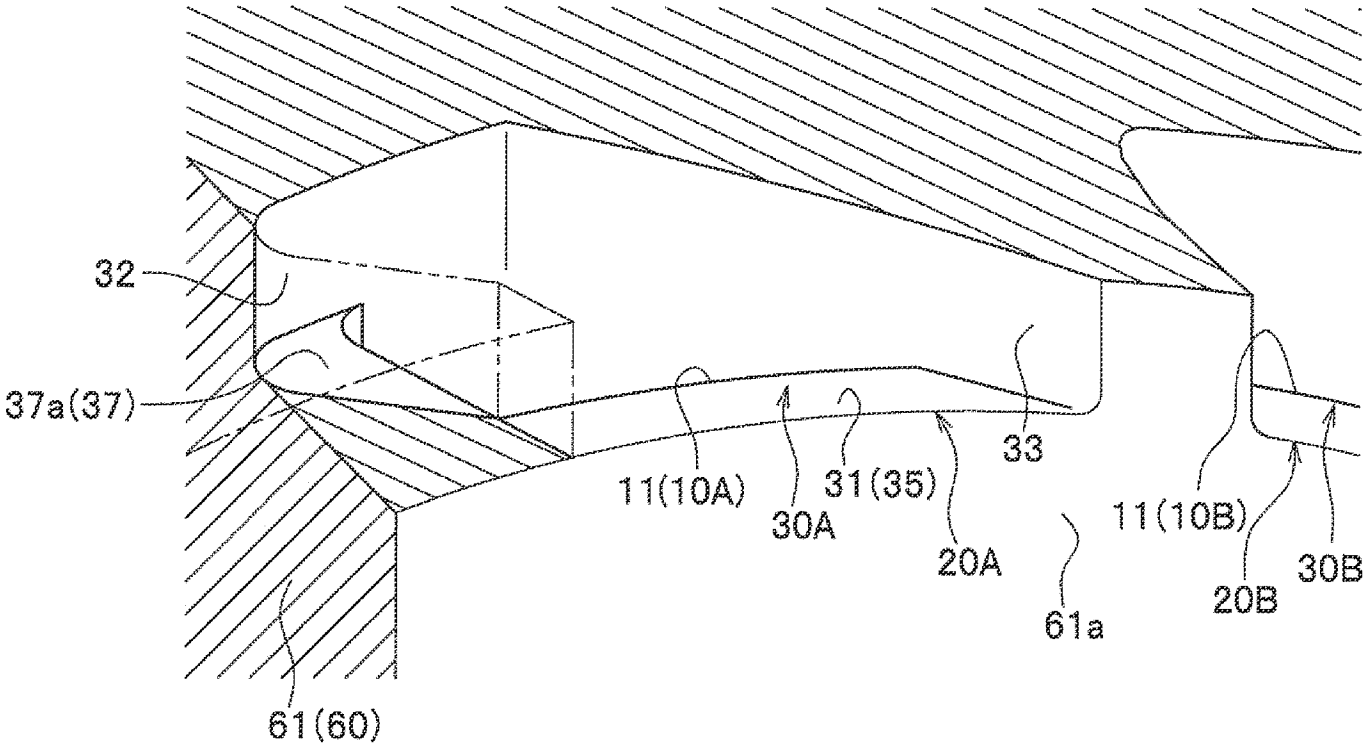
FIG. 8 is a enlarged cross-sectional perspective view of a portion of a first scavenging port of the second embodiment.

As illustrated in FIG. 8, the landing portion 37 of the second embodiment is a portion in an approximate triangular shape in planar view the width of which narrows from the back side of the first communication passage 30A towards the first scavenging ports 20A and has a planar surface 37*a* constituting a part of the bottom surfaces 31.

The planar surface 37*a*, as illustrated in FIG. 7, is a portion formed by laterally shifting a part of the side surface 32 on the exhaust port 81 side in the back towards the exhaust port 81 side with respect to the edge portion (an inner surface of the first scavenging passages 10A on the exhaust port 81 side) of the opening portion 11 on the exhaust port 81 side.

In the first communication passage 30A, as illustrated in FIG. 8, a stepped portion is formed by an inner circumferential surface of the first scavenging passage 10A, the landing portion 37, and the side surface 32 on the exhaust port 81 side (see FIG. 7), and the edge portion of the opening portion 11 and the side surface 32 on the exhaust port 81 side are separated in the lateral direction (the circumferential direction of the cylinder 61*a*) across the landing portion 37. In the periphery of the opening portion 11, a space expanded towards the exhaust port 81 side is formed over the landing portion 37.

The first communication passages 30A of the second embodiment are, similarly to those of the first communication passages 30A in the first embodiment (see FIG. 1), formed in a divergent form the cross-sectional areas of which expand from the opening portions 11 towards the first scavenging ports 20A. The cross-sectional areas of the first communication passages 30A in the axial direction of the cylinder 61*a* are made larger than the cross-sectional areas of the opening portions 11 in the radial direction of the cylinder 61*a*.

The engine 2 of the second embodiment thus configured has the following operations and effects.

As illustrated in FIG. 7, the space in the periphery of the opening portion 11 in the first communication passage 30A is expanded by the landing portion 37 that is formed between the opening portion 11 of the first scavenging passage 10A and the side surface 32 of the first communication passage 30A on the scavenging port side. In other words, the cross-sectional area of the first communication passage 30A in the axial direction of the cylinder 61*a* is made larger than the cross-sectional area of the opening portion 11 of the first scavenging passage 10A in the radial direction of the cylinder 61*a*. Accordingly, along with the descending of the piston 50, the mixture gas flowed in the first communication passages 30A from the opening portions 11 expand in the first communication passages 30A.

Because the first communication passages 30A are formed in a divergent form the cross-sectional areas of which expand from the opening portions 11 towards the first scavenging ports 20A, the mixture gas jetted in the combustion chamber 40 from the first scavenging ports 20A are effectively dispersed.

Therefore, because the atomization and mixture of the mixture gas can be promoted and the changes in the pressure and speed of the mixture gas can be caused, the scavenging efficiency and the combustion efficiency of the mixture gas can be substantially improved.

The mixture gas flows into the combustion chamber 40 from the first scavenging ports 20A is directed towards the far side from the exhaust port, whereby the amount of unburned mixture gas exhausted to the exhaust port 81 can be substantially reduced.

The post-combustion gas is pushed out to the exhaust port 81 by the mixture gas flowed in the combustion chamber 40 on the far side from the exhaust port from the respective scavenging ports 20A, 20B arranged on both sides of the exhaust port 81, whereby the scavenging efficiency of the mixture gas can be improved.

The action that the mixture gases flowed in the combustion chamber 40 from the respective scavenging ports 20A, 20B collide with one another in the combustion chamber 40 promotes the mixture and dispersion of the mixture gas, whereby the combustion efficiency of the mixture gas can be improved.

As described in the foregoing, with the engine 2 of the second embodiment, the amount of hydrocarbon (HC) contained in the exhaust gas can be substantially reduced and the scavenging efficiency and the combustion efficiency can be improved, whereby the amount of carbon monoxide (CO) contained in the exhaust gas can be substantially reduced.

As illustrated in FIG. 7, the landing portions 37 can be formed by laterally shifting the side surfaces 32 on the exhaust port 81 side towards the exhaust port 81 side with respect to the edge portion of the opening portions 11.

The scavenging efficiency and combustion efficiency being improved allows the cross-sectional areas of the scavenging passages 10A, 10B to be made small, thereby making the compression ratio of the mixture gas large in the crank chamber and the scavenging passages 10A, 10B, whereby the output performance of the engine 2 can be enhanced.

The cross-sectional areas of the scavenging passages 10A, 10B being made small allows the thickness of the sidewall portions of the lower case to be made large, whereby the receiving surfaces for the bearings that rotatably support the crank journal can be made large, and thus the simultaneous rotation of the bearings can be prevented and the durability of the bearings can be enhanced.

While the second embodiment of the present invention has been described in the foregoing, the invention is not restricted to the above-described second embodiment and, as similarly to the first embodiment, it can be modified as appropriate without departing the scope of the intent.

In the second embodiment, as illustrated in FIG. 7, while four of the scavenging ports 20A, 20B are formed, the number of scavenging ports is not restricted. As illustrated in FIG. 8, while the landing portion 37 is in a triangular shape in planar view, the shape thereof is not restricted. As illustrated in FIG. 7, while the opening portion 11 has a rectangular cross-section, the shape thereof is not restricted.

Other Embodiments

Figure 9A:
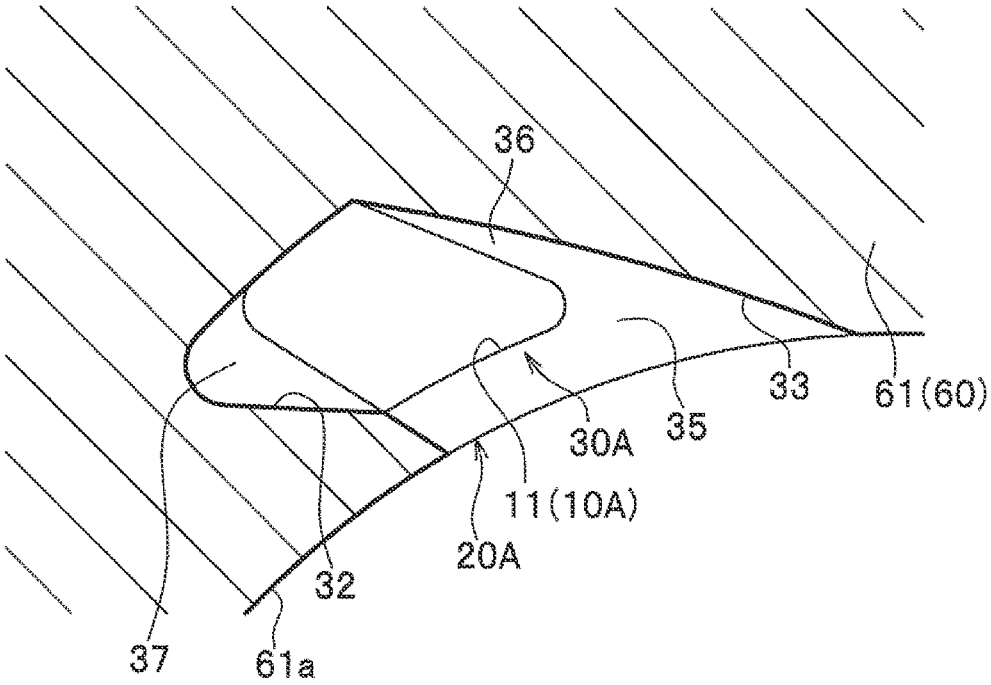
FIGS. 9A and 9B are diagrams illustrating first communication passages of other embodiments, 9A being a cross-sectional view of a configuration with landing portions formed on a far side from the exhaust port and on an exhaust port side and 9B being a cross-sectional view of a configuration with a landing portion formed in the back of an opening portion.
Figure 9B:
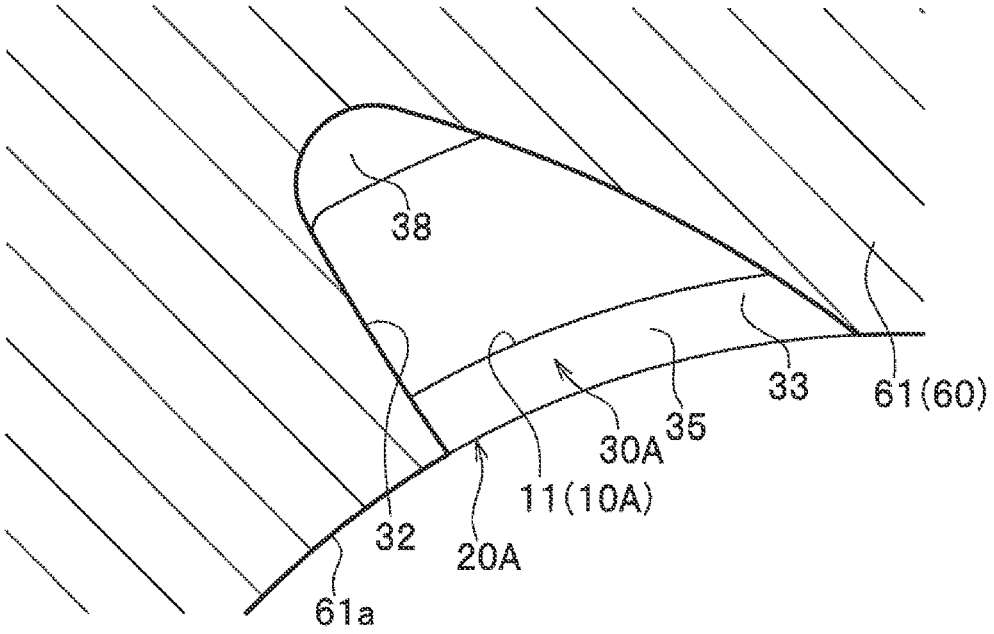

As for engines in other embodiments of the present invention, as illustrated in FIG. 9A, the landing portion 36 and the landing portion 37 may be formed between the edge portions of the opening portions 11 of the first scavenging passages 10A and the side surfaces 33 of the first communication passages 30A on the far side from the exhaust port and between the edge portions of the first scavenging passages 10A and the side surfaces 32 of the first communication passages 30A on the exhaust port side, respectively. In other words, as long as a space in the periphery of the opening portion 11 in the first communication passage 30A is expanded, the position of the landing portion is not restricted. Accordingly, as illustrated in FIG. 9B, a landing portion 38 may be formed in the back of the first communication passage 30A from the opening portion 11 (towards the outside of the upper block 61).

What is claimed is:

1. A two-stroke engine comprising:

a cylinder block formed with a cylinder and a crank chamber; and a piston slidably mounted in the cylinder, the cylinder block having formed therein:

an exhaust passage leading to a combustion chamber in the cylinder through an exhaust port opened to an inner circumferential surface of the cylinder, at least one scavenging port opened to the combustion chamber at an inner circumferential surface of the cylinder, a communication passage formed in the cylinder block and extending from the scavenging port in a radial direction of the cylinder, the communication passage having a bottom surface and first and second side surfaces, the second side surface being positioned between the exhaust passage and the first side surface, and a scavenging passage formed in an axial direction of the cylinder, communicating with the crank chamber, and having an opening portion formed on the bottom surface of the communication passage such that the communication passage extends from the scavenging port to the scavenging passage, the opening portion having a generally rectangular cross-section with a front edge adjacent the cylinder, a back edge opposite the front edge, and side edges spaced apart in the circumferential direction extending between the front and back edges, wherein the first side surface forming a part of the communication passage on a far side from the exhaust port is formed towards the far side from the exhaust port in the combustion chamber such that the scavenging port defines a width greater than a width of the opening portion of the scavenging passage, and a landing portion having a triangular shape is formed by the bottom surface of the communication passage in a periphery of the opening portion of the scavenging passage between the first side surface and the opening portion of the scavenging passage, wherein the landing portion is set in between one of the side edges of the opening portion of the scavenging passage and the side surface of the communication passage such that the side portion of the opening portion and the first side surface are separated from each other in the circumferential direction, and a stepped portion is formed by the side edge portion of the opening portion of the scavenging passage, the landing portion and the side surface of the communication passage in the communication passage.

2. The two-stroke engine according to claim 1, wherein the landing portion is set in between the opening portion of the scavenging passage and the side surface of the communication passage on the far side from the exhaust port.

3. The two-stroke engine according to claim 2, wherein the landing portion is formed by laterally shifting the side surface of the communication passage on the far side from the exhaust port towards the far side from the exhaust port with respect to the scavenging passage.

4. The two-stroke engine according to claim 1, wherein the landing portion is set in between the opening portion of the scavenging passage and a side surface of the communication passage on an exhaust port side.

5. The two-stroke engine according to claim 1, wherein a cross-sectional area of the communication passage in the axial direction of the cylinder is formed larger than a cross-sectional area of the scavenging passage in the radial direction of the cylinder.

6. The two-stroke engine according to claim 1, wherein an opening width of the communication passage in a circumferential direction of the cylinder is expanded from an opening portion side of the scavenging passage towards a scavenging port side.

7. The two-stroke engine according to claim 1, wherein a ceiling surface of the communication passage is inclined towards a cylinder head side from a scavenging passage side towards a scavenging port side.

8. The two-stroke engine according to claim 1, wherein two of the scavenging ports are formed on each side of the exhaust port.

* * * * *